US011384943B2

(12) United States Patent
Hainzlmaier et al.

(10) Patent No.: US 11,384,943 B2
(45) Date of Patent: Jul. 12, 2022

(54) HEAT EXCHANGER, IN PARTICULAR WATER-AIR-HEAT EXCHANGER OR OIL-WATER-HEAT EXCHANGER

(71) Applicant: Webasto SE, Stockdorf (DE)

(72) Inventors: Christian Hainzlmaier, Stockdorf (DE); Marvin Lappe, Stockdorf (DE); Christoph Cap, Stockdorf (DE); Karl Göttl, Stockdorf (DE); Hans Rechberger, Stockdorf (DE); Tobias Hentrich, Stockdorf (DE); Jürgen Lipp, Stockdorf (DE)

(73) Assignee: WEBASTO SE, Stockdorf (DE)

( * ) Notice: Subject to any disclaimer, the term of this patent is extended or adjusted under 35 U.S.C. 154(b) by 718 days.

(21) Appl. No.: 15/999,656

(22) PCT Filed: Feb. 14, 2017

(86) PCT No.: PCT/EP2017/053280
§ 371 (c)(1),
(2) Date: Aug. 20, 2018

(87) PCT Pub. No.: WO2017/140668
PCT Pub. Date: Aug. 24, 2017

(65) Prior Publication Data

US 2021/0207816 A1 Jul. 8, 2021

(30) Foreign Application Priority Data

Feb. 18, 2016 (DE) ..... 10 2016 102 895.9

(51) Int. Cl.

| | |
|---|---|
| ***F28F 9/02*** | (2006.01) |
| ***F24D 13/04*** | (2006.01) |
| ***F28F 13/18*** | (2006.01) |
| *F28D 9/00* | (2006.01) |
| *F28D 21/00* | (2006.01) |
| *H05B 3/12* | (2006.01) |

(52) U.S. Cl.
CPC ..... *F24D 13/04* (2013.01); *F28F 13/18* (2013.01); *F28D 9/005* (2013.01);
(Continued)

(58) Field of Classification Search
CPC .. F24D 13/04; F28F 13/18; F28F 9/02; F28D 9/005; F28D 2021/0094; H05B 3/12; H05B 2203/013
(Continued)

(56) References Cited

U.S. PATENT DOCUMENTS

| | | | |
|---|---|---|---|
| 6,178,292 B1 | 1/2001 | Fukuoka et al. | |
| 2007/0144716 A1* | 6/2007 | Doh | B01D 69/088 165/158 |

(Continued)

FOREIGN PATENT DOCUMENTS

| | | |
|---|---|---|
| DE | 101 57 399 A1 | 6/2003 |
| DE | 102011003296 A1 | 8/2012 |

(Continued)

OTHER PUBLICATIONS

First Office Action issued in connection with German Patent Application 10 2016 102 895.9 dated Oct. 24, 2016.

(Continued)

*Primary Examiner* — Davis D Hwu
(74) *Attorney, Agent, or Firm* — Quarles & Brady LLP

(57) ABSTRACT

The invention relates to a heat exchanger, in particular an water-air heat exchanger or oil-water heat exchanger, comprising at least one first fluid channel for guiding a first fluid, and at least one second fluid channel for guiding a second fluid, the at least one first fluid channel being joined to a fluid receiving volume, in particular on the outlet side, said fluid receiving volume being equipped with an electric heating coating (13).

8 Claims, 2 Drawing Sheets

(52) U.S. Cl.
CPC ..... *F28D 2021/0094* (2013.01); *F28F 9/02* (2013.01); *H05B 3/12* (2013.01); *H05B 2203/013* (2013.01)

(58) Field of Classification Search
USPC ..... 165/173
See application file for complete search history.

(56) References Cited

U.S. PATENT DOCUMENTS

| | | | | |
|---|---|---|---|---|
| 2012/0160290 | A1* | 6/2012 | Chen | F24S 10/95 136/206 |
| 2013/0180694 | A1 | 7/2013 | Englert et al. | |
| 2015/0093523 | A1* | 4/2015 | Kissell | C08L 47/00 428/34.1 |

FOREIGN PATENT DOCUMENTS

| | | | |
|---|---|---|---|
| DE | 102013010907 | A1 | 12/2014 |
| FR | 2966580 | A1 | 4/2012 |
| JP | H06117212 | A | 4/1994 |
| JP | 2002 283835 | A | 10/2002 |
| JP | 2004340441 | A | 12/2004 |
| JP | 2010113803 | A | 5/2010 |

OTHER PUBLICATIONS

English translation of PCT IPRP, Search Report and Written Opinion dated Aug. 21, 2018 in connection with PCT/EP2017/053280.

* cited by examiner

HEAT EXCHANGER, IN PARTICULAR WATER-AIR-HEAT EXCHANGER OR OIL-WATER-HEAT EXCHANGER

CROSS-REFERENCE TO RELATED APPLICATIONS

This application represents the national stage entry of PCT International Application No. PCT/EP2017/053280 filed on Feb. 14, 2017, and claims priority to German Patent Application No. 10 2016 102 895.9 filed on Feb. 18, 2016. The contents of these applications are hereby incorporated by reference as if set forth in their entirety herein.

The invention relates to a heat exchanger, in particular a water-air heat exchanger or an oil-water heat exchanger, and to a method for producing a heat exchanger, in particular a water-air heat exchanger or an oil-water heat exchanger.

For example, EP 2 466 241 A1 describes an oil-water heat exchanger having multiple trough elements stacked one on top of the other and soldered to one another. Such oil-water heat exchangers are commonly integrated into the cooling circuit of internal combustion engines and may be used for example for cooling the engine oil.

A further oil-water heat exchanger is presented in US 2015/0176913 A1. In a particular embodiment, said document proposes an electric heater in an interior space of the heat exchanger for the purposes of warming one of the fluids that interact with one another in the heat exchanger.

In the case of the known oil-water heat exchangers, it is basically perceived to be disadvantageous that, in these, preheating is either not possible at all, or is possible only with relatively great outlay and in an ineffective manner. In particular, the reduction of pollutants that form when the engine oil is not at operating temperature is considered to be in need of improvement.

With regard to the prior art, reference is basically also made to WO 2013/186106 A1 and WO 2013/030048 A1. Said documents describe heaters which have an electric heating layer which warms when an electrical voltage is applied (or when a Current flows).

With regard to the prior art, reference is also made to DE 10 2011 006 248 A1. Said document describes a household refrigeration appliance with a heating device. The heating device is produced as a layer heater by lacquering and is applied to a surface of an evaporator of the household refrigeration appliance. Specifically, the layer heater in DE 10 2011 006 248 A1 is applied a really directly to a surface of the evaporator and exhibits scarcely any thermally insulating action, so as to have only the least possible detrimental effect on the functionality of the evaporator. It is however considered to be disadvantageous that, according to said prior art, the production process is relatively cumbersome and appears to be tailored to a highly specific usage situation.

It is an object of the invention to propose a heat exchanger which permits warming of a fluid flowing through the heat exchanger in a simple and effective manner.

Said object is achieved by means of the features of claim 1.

In particular, the object is achieved by means of a heat exchanger, in particular water-air heat exchanger or oil-water heat exchanger, comprising at least one first fluid channel for conducting a first fluid (e.g. oil of an oil-water heat exchanger or water of a water-air heat exchanger), and at least one second fluid channel for conducting a second fluid (e.g. water of the oil-water heat exchanger or air of the water-air heat exchanger), wherein the at least one first fluid channel is connected to a fluid-receiving volume (in particular outlet side), wherein the fluid-receiving volume is equipped with an electric heating coating. The heat exchanger may generally be a liquid-liquid heat exchanger or liquid-gas heat exchanger or gas-gas heat exchanger.

The core concept of the invention lies in applying the electric heating coatings known per se for example from WO 2013/186106 A1 or WO 2013/030048 A1 to a fluid-receiving volume which is connected to at least one of the fluid channels. In this way (in particular if the electric heating coating is arranged at an outlet side), a fluid to be warmed by means of the heat exchanger can be additionally warmed in an effective manner, or the temperature of a fluid to be warmed can be increased further (in particular if the electric heating coating is connected at an inlet side to a fluid channel of the fluid to be warmed). Altogether, warming of a fluid, for example warming of an oil of an oil-water heat exchanger for an internal combustion engine of a motor vehicle, can be realized in an effective manner. The heat exchanger may have multiple first fluid channels and/or multiple second fluid channels. For example, the fluid-receiving volume is a volume of the heat exchanger before (or after) the fluid is distributed between multiple individual fluid channels (that is to say for example a fluid collecting device or fluid distributing device). The first fluid may be oil or water. The second fluid may be water or air. In general, the first and/or second fluid may be liquid or gaseous.

In a specific embodiment, the fluid-receiving volume is defined by a fluid-receiving vessel, in particular oil-receiving vessel. A fluid-receiving vessel, in particular oil-receiving vessel, of said type is preferably connected at an outlet side to one or more fluid channels through which preferably oil flows. In this way, additional warming (for example after the starting of the engine of a motor vehicle) can be realized in an effective manner.

In a specific embodiment, the fluid-receiving volume may be defined by a connecting pipe, in particular outlet pipe, preferably of an oil-water heat exchanger. In this way, additional warming of the fluid, in particular oil, is made possible in a simple manner (utilizing existing structures).

In one embodiment, a turbulator may be provided. This is preferably provided in the vicinity of an electric heating coating (that is to say in particular at a distance of no greater than 5 cm, in particular 2 cm). For example, the turbulator may be arranged within the outlet pipe (which is equipped with an electric heating coating).

The electric heating coating may basically be arranged on an outer wall of the fluid-receiving volume (for example outlet pipe) or on an inner wall of the fluid-receiving volume (for example outlet pipe). If a turbulator is provided, this may possibly also itself be equipped with an electric heating coating.

Preferably, the fluid-receiving volume is defined by a collecting box or collecting pipe, preferably of a water-air heat exchanger. In this way, warming of a fluid (for example of the water) can be performed in a simple manner in order to also warm the other fluid (for example air) by means of an exchange of heat.

In one embodiment, the fluid-receiving volume is an integrated constituent part of the heat exchanger. In this way, the heat exchanger can operate in a particularly effective manner.

In an alternative embodiment, the fluid-receiving volume is provided by a separate module, wherein the separate module is fastenable or fastened to the other constituent parts of the heat exchanger. In this embodiment, a separate fluid-receiving volume is thus proposed, such that existing heat exchangers (in particular oil-water heat exchangers) can be further improved by means of a simple upgrade. Secondly, the modular form of the fluid-receiving volume also has the advantage that production costs can possibly be reduced, for example by virtue of the same fluid-receiving module being used for different heat exchanger types and/or sizes.

The heating coating is particularly preferably designed for operation in the low-voltage range, preferably for 12 volts, 24 volts or 48 volts. Corresponding electrical and/or electronic components of the oil-water heat exchanger are then preferably likewise designed for such a low-voltage range (12 volts, 24 volts or 48 volts). In particular in the case of an application in the low-voltage range, effective preheating can be realized in a synergistic manner using simple means. The "low-voltage range" is to be understood preferably to mean an operating voltage of lower than 100 V, in particular lower than 60 V (direct current).

In one embodiment, the heating coating is applied indirectly, in particular over an insulation layer, on or in the fluid-receiving volume. An insulation layer of said type may for example be formed by an adhesion promoter layer or attached by means of an adhesion promoter layer of said type to the oil-water heat exchanger. For the insulation layer, use may preferably be made of a polymer material or a ceramic material (e.g. $Al_2O_3$). The insulation layer is however preferably provided by a passivation, in particular an oxidization, in particular anodization (of aluminium or of an aluminium alloy), preferably of a surface, for example of an outer and/or inner surface, of the fluid-receiving volume. Altogether (specifically in low-voltage applications), a simple and nevertheless adequate electrical insulation is provided. Alternatively, the heating coating may even be applied directly on or in the fluid-receiving volume (for example in low-voltage applications and/or if the underlying surface is not electrically conductive or only poorly electrically conductive). The heating coating and/or insulation layer is preferably applied to the fluid-receiving volume over the (full) surface. The heating coating and/or the insulation layer may furthermore have an (at least substantially) constant layer thickness. The heating coating and/or the insulation layer may be inherently of dimensionally unstable (or non-self-supporting) design. A substrate can be omitted, such that the heating coating (and optional insulation layer) is possibly formed without a substrate. A carrying and/or support structure that may be necessary can be provided by the fluid-receiving volume (or a wall thereof). The heating coating may basically be connected cohesively to a surface, in particular outer and/or inner surface of the fluid-receiving volume.

In an alternative embodiment, the heating coating is formed as a continuous (in particular unstructured and/or uninterrupted) layer. The heating coating may generally have at least one section within which, in two mutually perpendicular directions, there are no interruptions in the heating coating over a distance of at least 1 cm, preferably at least 2 cm, even more preferably at least 4 cm. For example, the heating coating may comprise at least one rectangular section with a length and a width of in each case at least 1 cm, preferably at least 2 cm, even more preferably at least 4 cm, within which there are no interruptions or possible other structures in the heating coating. An "interruption" within the heating coating is to be understood to mean a section through which no current can flow, for example because said section remains (entirely) free from material and/or is (at least partially) filled by an insulator. The heating coating may be (thermally) sprayed on (regardless of whether it is unstructured or structured in the final state). In this context, it has surprisingly been found that even a heating coating of such simple form can realize adequate warming of the oil.

In a further alternative embodiment, the heating coating is formed as a structured layer. The heating coating is in this case preferably structured by means of a masking process (preferably using silicone, which can be stamped). Such known masking processes permit satisfactory structuring and are less cumbersome than, for example, laser methods tor structuring, which are used specifically in the high-voltage range. Altogether, therefore, the advantages of a masking process are utilized in a synergistic manner with regard to the present heating coating.

The above-described insulating layer may have a thickness of at least 50 μm, preferably at least 200 μm and/or at most 1000 μm, preferably at most 500 μm.

The heating coating preferably has a height (thickness) of at least 5 μm, preferably at least 10 μm and/or at most 1 mm, preferably at most 500 μm, even more preferably at most 30 μm, even more preferably at most 20 μm. A conductor track defined by the heating coating may be at least 1 mm, preferably at least 3 mm, even more preferably at least 5 mm, even more preferably at least 10 mm, even more preferably at least 30 mm wide. The expression "width" is to be understood to mean the extent of the conductor track perpendicular to its longitudinal extent (which normally also defines the direction of the current flow).

In an alternative embodiment, a protective cover, for example a silicone protective layer, is applied over the heating coating. It is however alternatively also possible (in an embodiment which is particularly easy to produce) for the heating coating to define an outer side or inner side of the fluid-receiving volume.

In a specific embodiment, the oil-water heat exchanger has multiple modules, in particular trough elements, which may furthermore preferably be designed as described in EP 2 466 241 A1. The oil-water heat exchanger may basically (aside from the fluid-receiving volume according to the invention) be designed as described in EP 2 466 241 A1 or US 2015/0176913 A1. The disclosure of these documents is hereby expressly incorporated by reference. If multiple modules are provided, at least one heating coating may be arranged between two modules. If the oil-water heat exchanger comprises multiple trough elements, at least one heating coating may possibly be arranged (applied) between two of these trough elements (on one of the trough elements). In this way, the preheating (auxiliary heating) can be further improved using simple means. In general, an additional heating coating may be applied to further surfaces of the heat exchanger.

The object is furthermore achieved by means of a method for producing a heat exchanger, in particular a water-air heat exchanger or an oil-water heat exchanger, in particular of the type described above, comprising providing at least one first fluid channel for conducting a first fluid (e.g. an oil of the oil-water heat exchanger or water of the water-air heat exchanger) and at least one second fluid channel for conducting a second fluid (e.g. water of the oil-water heat exchanger or air of the water-air heat exchanger), wherein the at least one first fluid channel is connected to a fluid-receiving volume, in particular at an outlet side, wherein the fluid-receiving volume is equipped with an electric heating coating (or a surface of the fluid-receiving volume is directly or indirectly coated with the electric heating coating). Between the two abovementioned steps, the application of an insulation layer to a surface of the fluid-receiving volume can be performed (or a surface of the fluid-receiving volume can be directly or indirectly coated with the insulation layer), for example by means of a passivation (oxidation, in particular anodization) of an underlying surface, for example of a heat exchanger housing. The electric heating coating may possibly be (thermally) sprayed on. Where features relating at least also to the production of the oil-water heat exchanger are described further above (in conjunction with the heat exchanger), these method features are also proposed as preferred embodiments of the method.

The above-stated object is furthermore achieved through the use of a heat exchanger of the type described above, or produced in the manner described above, as a water-air heat exchanger or as an oil-water heat exchanger, in particular for the internal combustion engine of a motor vehicle.

Further embodiments emerge from the subclaims.

In general, the insulating layer may be a ceramic material or a polymer material or may be composed of such a material, wherein, as ceramic material, use is made for example of $Al_2O_3$.

The heating layer may be applied for example in a plasma coating process, in particular plasma spraying, or in a screenprinting process or as a resistance paste, in particular to the insulating layer. In the plasma coating process, it is for example firstly possible for an electrically conductive layer to be applied, in particular to the insulating layer. Regions may subsequently be cut out of the electrically conductive layer, such that a conductor track or multiple conductor tracks are left behind. Use is however preferably made of a masking technique. The conductor tracks may then form the heating resistor or multiple heating resistors. As an alternative to a masking technique, the stated regions may for example be cut out of the conductive layer by means of a laser. The heating coating may for example be a metal layer and possibly comprise nickel and/or chromium, or be composed of said materials. For example, use may be made of 70-90% nickel and 10-30% chromium, wherein a ratio of 80% nickel and 20% chromium is considered to be highly suitable.

The heating coating may for example cover an area of at least 5 $cm^2$, preferably at least 10 $cm^2$ and/or at most 200 $cm^2$, preferably at most 100 $cm^2$. The oil-water heat exchanger may have a total volume of preferably at least 200 $cm^3$, even more preferably at least 500 $cm^3$, even more preferably at least 800 $cm^3$ and/or at most 5000 $cm^3$, preferably at most 2000 $cm^3$. For example, the oil-water heat exchanger may be 15-25 cm long and/or 8-12 cm wide and/or 3-7 cm tall (thick).

The oil-water heat exchanger preferably has one or more first fluid channels for conducting the oil and one or more second fluid channels for conducting the water.

For control, in particular closed-loop control, of the electric heating coating, it is possible for a bimetal switch, possibly with two redundant switch devices, to be provided.

The invention will be described below on the basis of exemplary embodiments, which will be discussed in more detail on the basis of the figures. In the figures.

In the following description, the same reference signs will be used for identical parts and parts of identical action.

Figure 1:
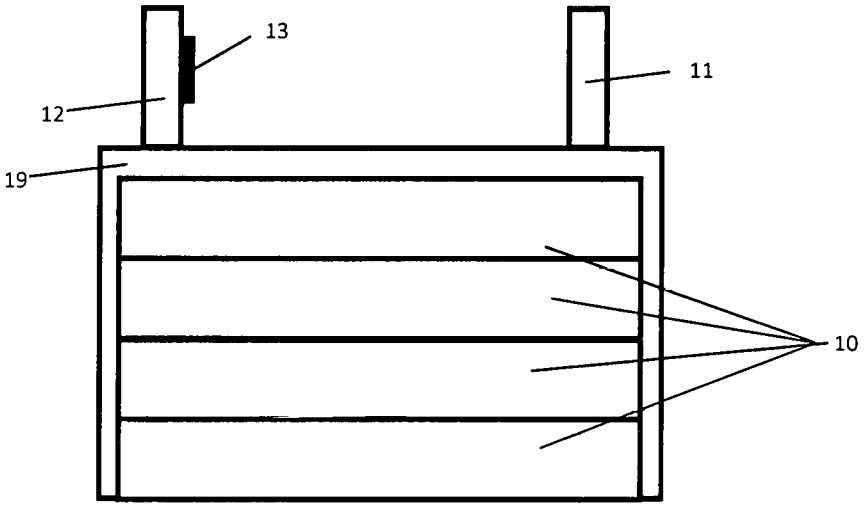
FIG. 1 shows a schematic side view of an oil-water heat exchanger as per a first embodiment of the invention.

FIG. 1 shows, in a schematic view, an oil-water heat exchanger (as described for example in detail in EP 2 466 241 A1) with multiple (soldered) trough elements 10, a cover 19, an inlet pipe 11 and an outlet pipe 12 for the oil flowing in the heat exchanger. An electric heating coating 13 is applied at least to the outlet pipe 12 (possibly in the inlet pipe 11).

Figure 2:
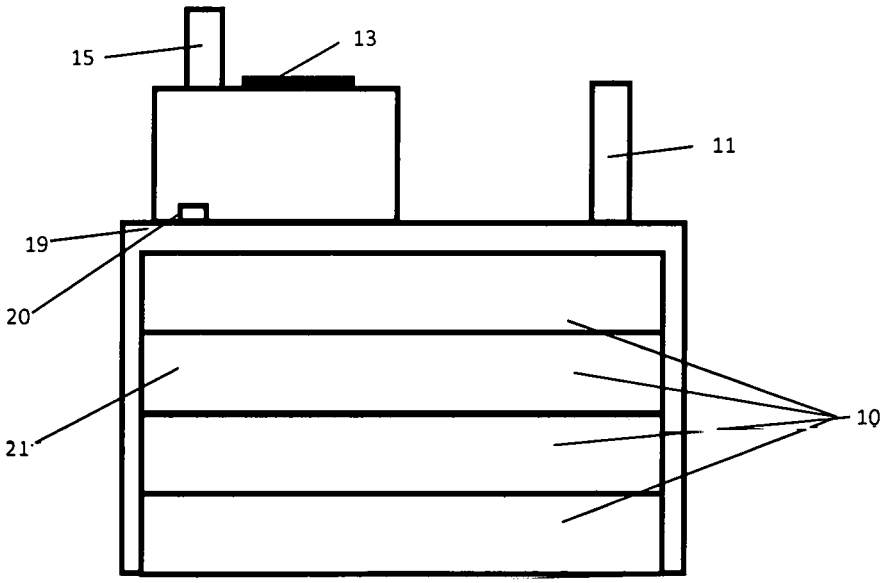
FIG. 2 shows an oil-water heat exchanger as per an alternative embodiment of the invention.

In the alternative embodiment as per FIG. 2, an electric heating coating 13 is arranged on a fluid-receiving vessel 14. The fluid-receiving vessel 14 has a (considerably) enlarged diameter in relation to the outlet pipe 12 as per FIG. 1 or a fluid-receiving vessel outlet pipe 15, such that the fluid (oil) can be stored in the fluid-receiving vessel 14. The fluid-receiving vessel 14 may for example be a cuboidal or cylindrical body. In the specific embodiment as per FIG. 2, the fluid-receiving vessel 14 is provided as an auxiliary module which is connected to an outlet 20 of a heat exchanger main body 21. It would also be conceivable for the fluid-receiving vessel 14 to be formed as an integral constituent part of the oil-water heat exchanger, such that the outlet 20 can be omitted.

Figure 3:
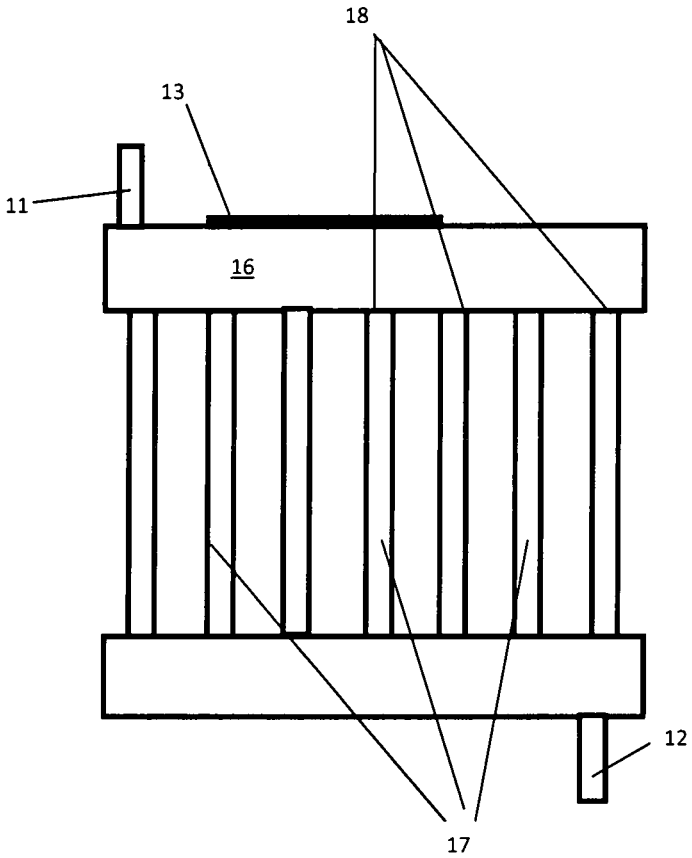
FIG. 3 shows a water-air heat exchanger as per an alternative embodiment of the invention.

FIG. 3 shows a water-air heat exchanger which has a collecting box 16 and heat exchanger pipes 17, wherein, both through the collecting vessel 16 and the heat exchanger pipes 17, water is provided for warming (or cooling) a gas (in particular air), which flows past the heat exchanger pipes 17. An electric heating coating 13 is situated on the collecting box 16. Multiple heat exchanger pipes 17 are connected by means of connection pieces 18 to the collecting box 16. It is possible for 3, or at least 5, or at least 20 heat exchanger pipes 17 to be connected to the same collecting box 16. The water can enter via an inlet (inlet pipe 11) and exit via an outlet (outlet pipe 12).

It is pointed out at this juncture that all of the above-described parts both individually and in any combination, in particular the details illustrated in the drawings, may be claimed as being essential to the invention. Modifications in relation to this are familiar to a person skilled in the art.

REFERENCE SIGNS

10 Trough element
11 Inlet pipe
12 Outlet pipe
13 Electric heating coating
14 Fluid-receiving vessel
15 Fluid-receiving vessel outlet pipe
16 Collecting box
17 Heat exchanger pipe
18 Connection device
19 Cover
20 Outlet
21 Heat exchanger main body

The invention claimed is:

1. A heat exchanger comprising at least one first fluid channel for conducting a first fluid, and at least one second fluid channel for conducting a second fluid, wherein the at least one first fluid channel is connected to a fluid-receiving volume at an outlet side, wherein the fluid-receiving volume is equipped with an electric heating coating, wherein the fluid-receiving volume is provided by a separate module, wherein the separate module is fastenable or fastened to the other constituent parts of the heat exchanger, and wherein the fluid receiving volume is defined by an outlet pipe.

2. The heat exchanger according to claim 1, wherein a turbulator is provided in the vicinity of an electric heating coating.

3. The heat exchanger according to claim 1, wherein the fluid-receiving volume is an integral constituent part of the heat exchanger.

4. The heat exchanger according to claim 1, wherein the electric heating coating is designed for operation in a low-voltage range, the low voltage range being one of 12 volts, 24 volts or 48 volts.

5. A method for producing a heat exchanger, comprising the steps:

providing at least one first fluid channel for conducting a first fluid, and a second fluid channel for conducting a second fluid, wherein the at least one first fluid channel is connected to a fluid-receiving volume at an outlet side, wherein the fluid-receiving volume is equipped with an electric heating coating, wherein the fluid-receiving volume is provided by a separate module, wherein the separate module is fastenable or fastened to the other constituent parts of the heat exchanger, and wherein the fluid-receiving volume is defined by an outlet pipe.

6. The heat exchanger, according to claim 1, wherein the heat exchanger is a water-air heat exchanger or as an oil-water heat exchanger for the internal combustion engine of a motor vehicle.

7. The heat exchanger according to claim 1, wherein the heat exchanger is at least one of a water-air heat exchanger or an oil-water heat exchanger.

8. The method according to claim 5, wherein the heat exchanger is at least one of a water-air heat exchanger or an oil-water heat exchanger.

* * * * *